United States Patent [19]

Schottle et al.

[11] 4,220,085

[45] Sep. 2, 1980

[54] LOW-NOISE PRINTING DEVICE

[75] Inventors: Helmut A. M. Schottle, Berlin; Helmut Müller, Hilchenbach-Oberndorf, both of Fed. Rep. of Germany

[73] Assignee: Pitney Bowes Inc., Stamford, Conn.

[21] Appl. No.: 752,589

[22] Filed: Dec. 20, 1976

Related U.S. Application Data

[63] Continuation of Ser. No. 635,392, Nov. 26, 1975, abandoned.

[30] Foreign Application Priority Data

Dec. 3, 1974 [DE] Fed. Rep. of Germany ..... 2457114

[51] Int. Cl.[3] ..... B41F 1/06

[52] U.S. Cl. ..... 101/316; 101/287

[58] Field of Search ..... 101/4, 9–11, 101/18–20, 26, 27, 93.37–93.43, 426, 287–292, 293, 294

[56] References Cited

U.S. PATENT DOCUMENTS

| | | | |
|---|---|---|---|
| 2,126,861 | 8/1938 | Altvater | 101/318 |
| 2,258,880 | 10/1941 | Bobst | 101/287 X |
| 2,339,199 | 1/1944 | Smith | 101/426 X |
| 2,620,726 | 12/1952 | Toskelson | 101/19 |
| 3,198,168 | 8/1965 | Grupe | 101/287 X |
| 3,592,311 | 7/1971 | Chou | 400/124 |
| 3,690,431 | 9/1972 | Howard | 400/124 |
| 3,693,543 | 9/1972 | Noller | 101/287 |
| 3,912,068 | 10/1975 | Kwan et al. | 197/127 R |

*Primary Examiner*—Edward M. Coven
*Attorney, Agent, or Firm*—Peter Vrahotes; William D. Soltow, Jr.; Albert W. Scribner

[57] ABSTRACT

This invention relates to a printing device having a flat printing pad and a printing anvil that serves as a support for a data carrier having raised characters. The device makes printing impressions upon printing assemblies which include at least one sheet of paper and an ink transferring ribbon or carbon paper interspaced between the data carrier and the sheet of paper. After a printing operation on one printing assembly, the printing pad and printing anvil are separated for removal of the assembly. Mechanical means then brings the pad close to the anvil following insertion of the next assembly. An electromagnetic driving mechanism is provided by means of which the printing pad and the printing anvil printingly engage one another for attaining an impression on the printing assembly.

9 Claims, 2 Drawing Figures

LOW-NOISE PRINTING DEVICE

Figure 1:
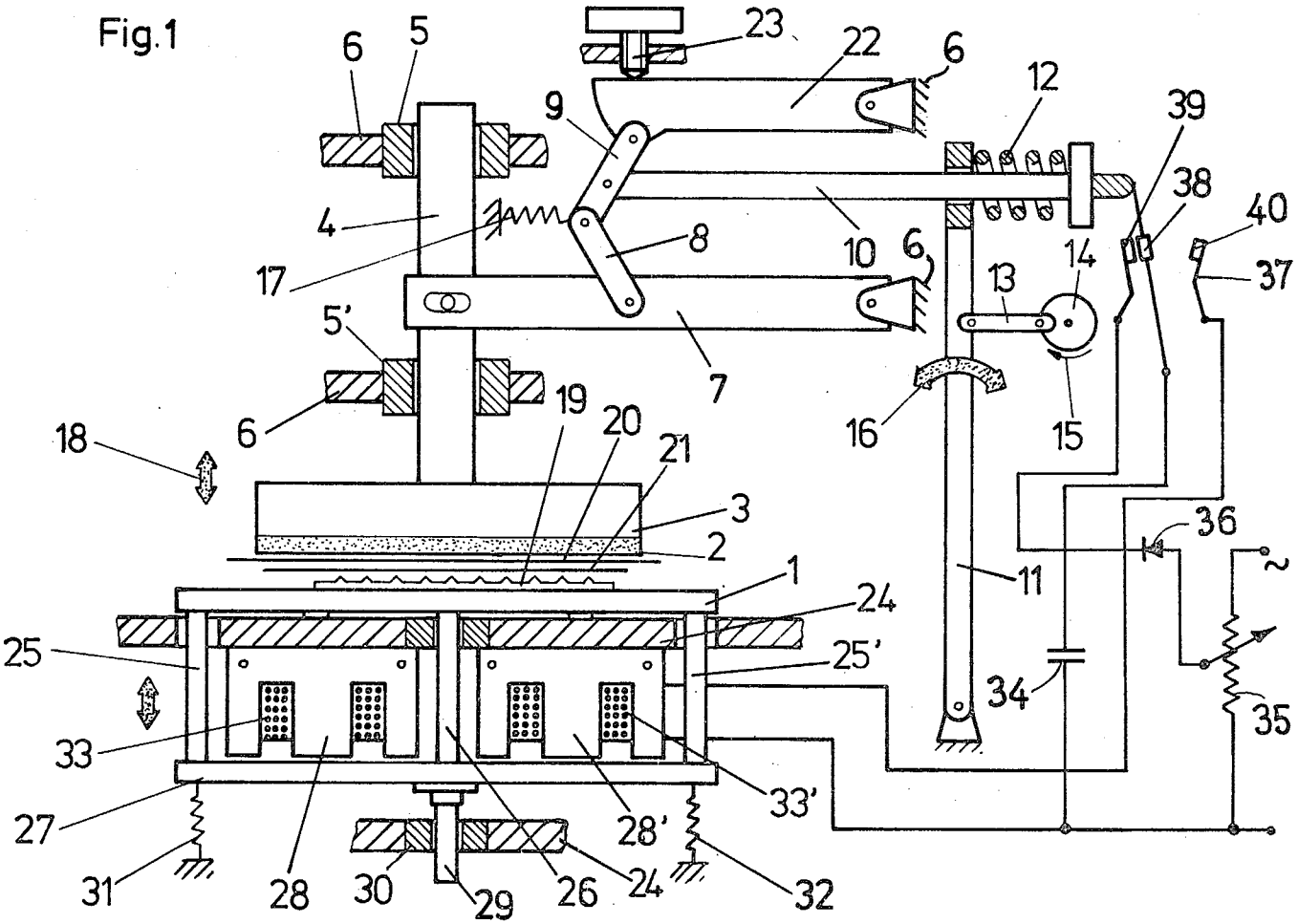

This is a continuation of application Ser. No. 635,392 filed Nov. 26, 1975, abandoned.

BACKGROUND OF THE INVENTION

Printing device of the kind to which this invention is directed is exemplified in French patent FR-PS 1,353,604. An electromagnetic driving mechanism is provided, which, when operated, drives a printing pad to accelerate the printing pad from its initial position, from which it has to travel a relatively great distance to engage a printing assembly positioned on a data carrier. Upon striking the printing assembly, the printing pad is decelerated, consequently reducing the force of impression which depends upon the speed of the printing pad, as well as the mass of the printing pad and movable parts associated with it. Other patents which also show the state of the art are French Pat. No. 815,981 and German Pat. Nos. 839,358 and 908,622.

In other printing devices, particularly manually operated address printing machines, for a long time it has been customary to have the printing pad mounted upon a vertically moveable lever by means of which the printing pad could be driven with high speed against a printing assembly in order to achieve an impression thereon.

Experiences have shown that when multi-layered form assemblies with interdispersed carbon papers are used, distinctly improved resolution of the letters is achieved if the surge of impression speed is increased. Sharp and well defined letters are obtained along with an increase of letter blackness. In all the known printing devices, until now, the necessary force of impression with high speed has been achieved by means of having either a type bar, a type segment, or a type wheel which strikes the printing assembly with high speed, or that strikes the forms to be printed, together with the ink ribbon, against a rotating type wheel, for example, by means of a printing hammer.

In the prior art printing devices it has been found that the transferring of kinetic energy into work leads to a considerable high noise level. To avoid this, sound dampening means have been used which, as a rule, lead to certain technical difficulties. Alternatively, the impact speed is reduced and the force required for impression increased in order to reduce the noise level. This leads to the disadvantage that the legibility of the copies is adversely affected.

SUMMARY OF THE INVENTION

The instant invention provides an improved printing device of the aforementioned kind that has the advantages of high impact speed without the normal drawbacks, particularly without a high noise level.

The printing device according to the invention is characterized by having two driving systems, one of which moves the printing device into the operating position, with a minimum of power, and the other of which causes an extremely short printing impulse, which is necessary to achieve the ink transfer, with a minimum of movement. In this way, high quality impressions, particularly impressions made simultaneously on several copies, are achieved and, moreover, a considerably reduced noise level is attained.

The two driving systems can be connected so as to be subsequently actuated in the same direction. A simpler manner, however, is an embodiment having the printing anvil and the printing pad mounted to be moved towards one another transversally relative to their plane surfaces, and a guide mechanism for reducing the distance between the printing pad and the printing anvil for virtual engagement therebetween. Subsequently, an electromagnetic impulse printing device exerts a very short impression impulse onto the printing assembly after the first driving system has reduced the distance between the printing pad and the anvil.

It has been found structurally advantageous to arrange to have the printing pad movable from its initial position into its operating position, by means of a guide mechanism, and to be located directly before or virtually engaging the printing assembly supported upon the printing anvil, and to arrange to have the printing anvil mounted and connected to an impulse printing device, represented by an electromagnetic lifting mechanism, which exerts a short impression impulse onto the printing assembly.

In such a printing device the period of a printing operation cycle can be reduced in a simple way by triggering the printing impulse of the control circuit of the electromagnetic impulse printing device through a switch which is actuated by the guide mechanism when the printing pad arrives at its operating position.

An especially simple construction is achieved by connecting the printing anvil, consisting of a flat plate supported by the table of the printing device, to an armature plate, which together with an electromagnet fixed to the bottom surface of the table constitutes the impulse printing device, by means of supports extending through apertures in the table of the printing device. To ensure accurate operation of the impulse printing device, in addition to the supports at the armature plate, which connect the printing anvil to the armature plate, another guide support is provided which is movably mounted in the table of the printing device and is located opposite the printing anvil.

In order to move the printing pad and the printing anvil into the operating position, in which the distance between each other is reduced, various guide mechanisms may be used. It has been found advantageous in one embodiment to provide a guide mechanism for the relative approaching of the printing pad and the printing anvil, including a toggle joint mechanism which is involved in the transmission of the printing forces and, when in its upright position, absorbs the forces of reaction. In this way, the time increment for moving the printing pad into its operating position can be shortened and there will no longer be need for the otherwise necessary clutching between a motor and a crank gear. In a very advantageous way, the toggle joint system comprises two toggle levers hinged together and kept under the influence of a return spring, one being stationary and the other being directly hinged to the printing pad. A crank mechanism is provided for moving the toggle joint into its upright position, in which position the printing pad is located in its operating position. Alternately, an electromagnetic driving mechanism could be used.

The above toggle joint system assures that a finger, or the like, which carelessly comes into the area under the printing pad, cannot be hurt. The crank mechanism includes a crank gear, which is actuated through a driving rod and a rocker lever, which crank gear acts on one of the toggle levers through an intermediate spring. A very simple operation results from hinging to the toggle lever a tie rod to which the rocker lever is coupled by means of a coil spring.

The stationary hinge point of one of the toggle levers is adjustable in order to adapt the toggle joint system to the different thickness of the printing assembly. Advisably, the stationary hinge point, therefore, is arranged at the free end of the pivotally mounted levers, which supports an adjusting screw that determines the respective rocker position.

It has been found very suitable for the control of the electromagnetic lifting mechanism to provide a switch, which is actuated when printing pad arrives at its operating position, through the discharging of a capacitor which has been charged by the windings of an electromagnetic impulse printing device. The switch which is to be actuated when the printing pad arrives at its operating position advantageously is a reversing single pole, double throw switch, by means of which the capacitor can be disconnected from the charging circuit and connected to the windings of the impulse printing device.

Instead of using a guide mechanism with a toggle joint system for the mutual approaching of the printing pad and the printing anvil, alternatively, a guide mechanism could be provided having a cam for overcoming the force of a spring which is effective to separate the printing pad and anvil. The cam which drives the push rod of the printing pad, is rotatably mounted on a shaft which extends transversely to the axis of the push rod and which is mounted in the housing of the printing device.

A very simple operation can be achieved if the cam is rotatable against the effect of a return spring by means of a hand lever to which it is connected.

For the adaption to the different thickness of the printing assembly, it has been shown very advantageous to mount the shaft which supports the cam by means of eccentric members mounted in the housing of the printing device. Appropriately, one of the eccentric members is connected to a latch ring which is rotatably mounted in the housing of the printing device and lockable in a desired position by means of a pawl associated to it.

In the above embodiment, in which the shaft supporting the push rod is mounted in the housing of the printing device by means of eccentric members in order to attain an adaption to the width of the respective printing assembly, the cam is provided with a cylindrical sector adjacent to a helical sector. As soon as the cylindrical sector engages the push rod of the printing pad, the absorption of the forces of reaction of the printing pad is assured.

The eccentric members for the mounting of the cam, however, can be omitted in a variant printing device which is characterized by the choice of such a slight pitch that is self-locking when actuated by the forces acting on the printing pad.

Figure 2:
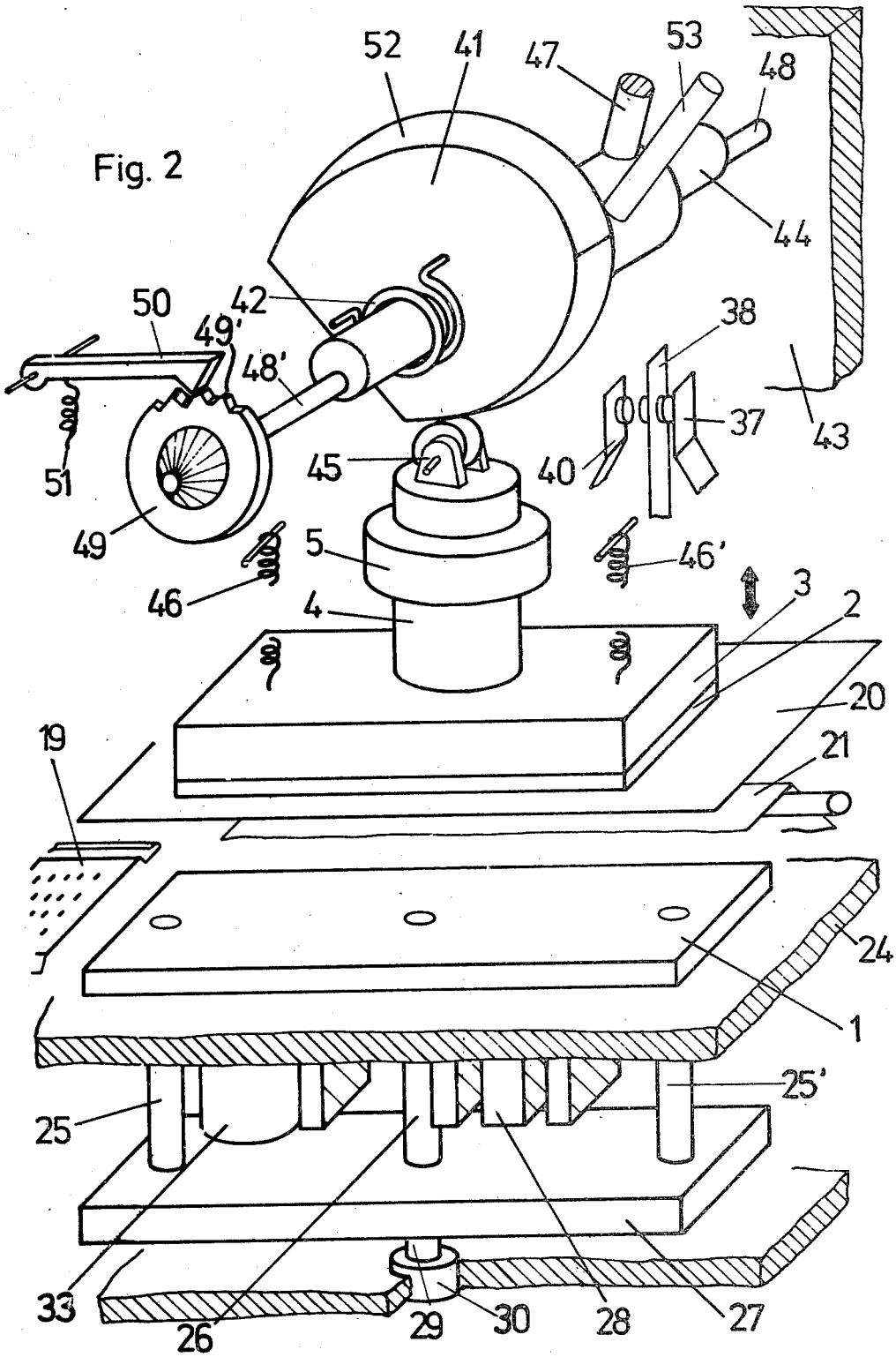

Other details, advantages and characteristics of the invention will become apparent from the following description and by reference to the accompanying drawings which by way of illustration show preferred embodiments, wherein:

FIG. 1 is a cross-sectional, partially schematic, longitudinal view of a first embodiment of a printing device embodying the principles of the invention and FIG. 2 is a perspective view of a second embodiment of a printing device according to the invention wherein like parts have the same number as in FIG. 1.

With reference now to the drawing, the illustrated printing device has a printing anvil 1 and an opposed printing pad 2 supported on a printing pad carrier 3. The printing pad 2 is operatively connected to a push rod 4 through the printing pad carrier 3 and the push rod 4 is received within sleeve bearings 5, 5' of a housing 6 of the printing device. A drive lever 7, which is pivotally mounted at one end to the housing 6 of the printing device, has its free end hinged to the push rod 4 of the printing pad 2. Connected to this drive lever 7 is a toggle lever 8 of a toggle system 8, 9. The toggle lever 9 is pivotably mounted and has a tie rod 10 pivotably attached to its middle area. The rod 10 extends through a bore 11' at the outer end of a rocker lever 11 which is pivotably mounted to the housing 6. The rocker lever 11 is coupled to the tie rod 10 by means of a coil spring 12. In order to drive the toggle system 8, 9 through the rocker lever 11, the rocker lever 11 is connected to a crank gear 14 through a driving rod 13. When the crank gear 14 rotates in the direction as indicated by the arrow 15 the rocker lever 11 starts a reciprocating motion in the direction as indicated by arrow 16. By means of cooperation with the coil spring 12, the rocker lever 11 reciprocally drives the tie rod 10, which moves the toggle joint system 8, 9 against the force of a spring 17 acting on it, into an upright position, and therewith the push rod 4 together with the printed pad 2 is driven in the direction as indicated by the arrow 18 toward the printing anvil 1.

The printing anvil 1 serves as a support for a printing plate or data card 19 having raised characters thereon, such as an address printing plate, a foil card or a credit card or the like, and a printing assembly comprising at least one sheet of paper 20 and an interposed ink transferring ribbon 21, or carbon paper.

In order to make the printing pad 2 adjustable to the thickness of a printing assembly 20, 21 when the toggle joint system 8, 9 is in the upright position, the stationary hinge point of toggle lever 9 is acted upon by the free end of a pivotally mounted lever 22 which is engaged by an adjusting screw 23 that determines the vertical position of the toggle joint system. This particular adjusting device for the adaption to the different thickness of the printing assembly is only necessary if the thickness range is so extensive that the self-locking area of the toggle joint system 8, 9 provides no space between the data card 19 and printing pad 2.

The printing anvil 1 rests on a table 24 of the printing device. At its bottom surface the printing anvil 1 is provided with two side supports 25, 25' and a middle support 26 which extend through apertures in the table 24 of the printing device. By means of these supports 25, 25', and 26 the printing anvil 1 is connected to an armature plate 27. This armature plate 27, together with electromagnets 28, 28' fixed to the bottom surface of the table 24, constitute an electromagnetic impulse device, represented in the illustrated embodiment as a lifting device. The lower surface of the armature plate 27 is provided with a guide support 29, that is vertically aligned with and appears as an extension of the support 26, which guide support is received within a sleeve bearing 30 which is mounted in the table 24 of the printing device. In order to assist the printing anvil 1 to return in its initial position, as illustrated in the drawing, tension springs 31 and 32 are secured to the bottom surface of the armature plate 27 to bias the plate downwardly.

The electromagnets 28, 28' of the electromagnetic impulse printing device are provided with windings 33, 33' which are connected to a control circuit for operating the impulse printing device, as soon as the printing pad 2 arrives at the operating position, into which it has been moved by means of the lowering mechanism of the toggle system 8, 9. This control circuit comprises a capacitor 34, which is chargeable through a variable resistor 35, a rectifier 36, and a reversing (double-through) switch 37. This reversing switch 37 comprises a middle reversing switch contact 38, which can be moved from a first position in which it engages a first contact 39, into a second position where it engages a second contact 40. The first contact 39 is connected to the rectifier 36, so that the charging of the capacitor 24 is ensured when the middle contact 38 is in engagement with the first contact 39. When the middle contact 38 engages the second contact 40, the capacitor 34 is connected to the windings 33, 33' of the electromagnets 28, 28' so that the electromagnets 28, 28' are operated based on the momentary discharge current impulse thereby attracting the armature plate 27. The armature plate 27 exerts impression impulses upon the printing plate 19 and the printing assembly 20, 21 located on the printing anvil 1, through the supports 25, 25', 26, thereby causing the paper 20 to be imprinted. After the capacitor is discharged, electromagnet is disabled and the printing pad 2 is lifted through the action of the crank gear 14, and springs 12, 17. For this, the armature plate 27 together with the connected printing anvil 1 occupies a relatively small space.

As is apparent from FIG. 1, the reversing switch 37 is arranged relative to the tied rod 10 of the toggle joint system 8, 9 so that the middle contact 38 of the reversing switch 37 engages the second contact 40 at that moment when the toggle joint system, 8, 9 achieves its upright position and the printing pad 2 arrives at its operating position, thereby enabling the electromagnets 33, 33' to complete the printing operation as previously described.

The printing device as illustrated in the FIG. 2 is an alternate embodiment of the invention and like parts corresponding to those parts of the device shown in FIG. 1 are numbered the same. In this second embodiment, the printing anvil 1 is liftable in the direction towards the printing pad 2 by means of a momentary impression impulse provided by the electromagnetic impulse printing device as soon as the reversing switch 37 is actuated. The circuit of the switch 37 is like the one shown in FIG. 1.

In the embodiment according to FIG. 2, the guide mechanism for the mutual approaching of the printing pad 2 and the printing anvil 1 comprises a cam 41 which is rotated against the force of a return spring 42. For this purpose, the cam 41 is rotatably mounted on a shaft 44 which is disposed within the housing 43 of the printing device and the shaft extends in a transverse direction relative to the axis of the push rod 4. A roll 45 is rotatably mounted at the upper end of the push rod 4 and is kept in engagement with the cam 41 by means of two springs 46, 46' which act on the printing pad carrier 3 to urge the printing pad 2 away from the printing anvil 1. The cam 41 is rotatable against the force of the return spring 42 by means of a hand lever 47 which is connected to the cam.

As is apparent from FIG. 2, the shaft 44 which carries the cam 41 is eccentrically mounted in the housing 43 of the printing device through the shafts 48, 48' which are mounted off-center to the shaft 44. Connected to one of these shafts is a latch ring 49 which is rotatably mounted in the housing of the printing device, in a manner not shown. The latch ring 49 has teeth 49' on a portion of its perimeter and is lockable in a desired position by the engagement of the teeth by an associated pawl 50 which is under the influence of the force of a spring 51. The presence of the eccentrically mounted shafts is to allow adjustment of the location of the cam to provide for printing assembly of various widths. The latch ring 49 and pawl 50 lock the shafts 48, 48' in their selected positions. Finally, as can be seen in FIG. 2, the cam 41 has a cylindrical sector 52.

In operation, the shaft 44 is rotated manually by means of the hand lever 47 in a clockwise direction. As soon as the roll 45 engages the cylindrical sector 52 of the cam 41, the maximum downward movement of the printing pad 2 in the direction to the printing assembly 20, 21 has been achieved. For accomplishing the operation of the impulse printing device at this moment, a trip pin 53 is associated with the cam 41 and serves to actuate the middle contact 38 of the reversing switch 37. The reverse switching energizes the electromagnets 28, 28' as described in the first embodiment and the printing operation is completed.

In lieu of arranging a cylindrical sector 52, the cam 41 can be provided with a slight pitch in one part of its perimeter resulting in a self-locking zone for the forces of reaction caused by the printing pad 2. In this case, it is possible to omit an adjusting area for the vertical adjustment of the cam 41 for the adaption to the width of the respective printing assembly.

What is claimed is:

1. A printing device, comprising:

a housing;

an anvil movably supported within said housing, said anvil having a flat surface adapted to receive a printing plate;

a printing pad having a flat surface located opposite the flat surface of said anvil;

mechanical means for driving said printing pad from a first position to a second position, said printing pad being directly before and spaced from said anvil when in said second position;

electromagnetic drive means operative to drive said anvil into printing engagement with said printing pad after said mechanical means has driven said printing pad to said second position; and means for enabling said electromagnetic drive means.

2. The printing device of claim 1 wherein said enabling means is responsive to said mechanical means to be actuated thereby.

3. A printing device, comprising:

a housing;

an anvil movably supported by said housing, said anvil having a flat surface adapted to receive a printing plate;

a printing pad having a flat surface located opposite the flat surface of said anvil;

biasing means supported by said housing and operatively engaging said anvil for urging said anvil away from said printing pad;

mechanical means for driving said printing pad from a first position to a second position, said printing pad being directed before and spaced from said anvil when in said second position;

electromagnetic drive means for overcoming said biasing means to drive said anvil into printing engagement with said printing pad after said mechanical means has driven said printing pad to said second position; and means for enabling said electromagnetic drive means.

4. The printing device of claim 2 wherein said enabling means is responsive to said mechanical means to be actuated thereby.

5. The printer device of claim 4 wherein said mechanical means comprises:

a push rod slidably supported in said housing which operatively engages said printing pad;

a drive lever pivotably supported by said housing and pivotably engaging said push rod;

a toggle joint having one end pivotably engaging said drive lever intermediate its ends, said drive lever being located intermediate the printing pad and the toggle joint;

means for pivotably supporting the other end of said toggle joint within said housing;

a spring supported within said housing and engaging one side of said toggle joint to bias said toggle joint into a bent position, in which position said printing pad is displaced from said anvil;

a tie rod pivotably engaging said toggle joint on the side opposite said spring; and means for reciprocally driving said tie rod to overcome said spring and place said toggle joint into its extended position, in which position said printing pad is driven by the interaction of the drive lever and push rod into its operating position.

6. The printing device of claim 5 wherein said electromagnetic means comprises at least one electromagnet operatively connected to said anvil and having an electrical winding thereabout, said electric winding being electrically connected to a switch to be energized thereby.

7. A printing device, comprising:

a housing;

a table slidably supported by said housing, said table having a flat surface defining an anvil which is adapted to receive a data card;

a printing pad member having a surface located opposite to said anvil;

a push rod operatively connected to the printing pad member and slidably supported by said housing, said push rod being operative to move said printing pad member toward and away from said anvil;

a drive lever having one end pivotably connected to said housing and its opposite end pivotably connected to said push rod;

a toggle joint assembly pivotably connected intermediate the ends of said drive lever;

means for driving said toggle into and out of its upright position to thereby reciprocate said push rod, said printing pad being directly before and spaced from said anvil when said toggle joint is upright;

electromagnetic means operative to drive said anvil into printing relationship with said printing pad; and means for enabling said electromagnetic means when said toggle joint is in its upright position.

8. A printing device, comprising:

a housing;

a table slidably supported by said housing, said table having a flat surface defining an anvil which is adapted to receive a data card;

a printing pad member having a surface located opposite to said anvil;

biasing means supported by said housing and engaging said printing pad member to bias said printing pad member away from said anvil;

a push rod operatively connected to the printing pad member and slidably supported by said housing;

a shaft rotatably supported by said housing transversely relative to said push rod;

a cam member secured to said shaft for rotation therewith and in engagement with said push rod;

means for rotating said shaft thereby reciprocating said push rod by the engagement with said cam to thereby overcome said biasing means, said printing pad being directly before and spaced from said anvil when said cam is engaged at its apex;

electromagnetic means operative to drive said anvil into printing relationship with said printing pad; and means for enabling said electromagnetic means when said push rod has been moved toward said anvil the maximum amount by said cam.

9. The printing device of claim 8 wherein said shaft is eccentrically mounted.

* * * * *